US008429888B2

(12) United States Patent
Del Río Rodriguez et al.

(10) Patent No.: US 8,429,888 B2
(45) Date of Patent: Apr. 30, 2013

(54) HIGH ELONGATION STEEL CORD WITH PREFORMED STRANDS

(75) Inventors: Javier Del Río Rodriguez, Lille (FR); Steven Wostyn, Desselgem (BE)

(73) Assignee: NV Bekaert SA, Zwevegem (BE)

( * ) Notice: Subject to any disclaimer, the term of this patent is extended or adjusted under 35 U.S.C. 154(b) by 0 days.

(21) Appl. No.: 13/257,474

(22) PCT Filed: Mar. 9, 2010

(86) PCT No.: PCT/EP2010/052943

§ 371 (c)(1),
(2), (4) Date: Sep. 19, 2011

(87) PCT Pub. No.: WO2010/112304

PCT Pub. Date: Oct. 7, 2010

(65) Prior Publication Data

US 2012/0011823 A1 Jan. 19, 2012

(30) Foreign Application Priority Data

Apr. 3, 2009 (EP) ..... 09157286

(51) Int. Cl.
*D07B 1/06* (2006.01)

(52) U.S. Cl.
USPC ..... 57/237; 57/311

(58) Field of Classification Search ..... 57/237, 57/311
See application file for complete search history.

(56) References Cited

U.S. PATENT DOCUMENTS

| | | | | |
|---|---|---|---|---|
| 5,319,915 | A * | 6/1994 | Kobayashi et al. | 57/200 |
| 5,661,966 | A | 9/1997 | Matsumaru | |
| 5,722,226 | A * | 3/1998 | Matsumaru | 57/311 |
| 6,089,293 | A * | 7/2000 | Niderost | 152/527 |
| 7,552,753 | B2 * | 6/2009 | Armellin et al. | 152/527 |
| 2003/0221762 | A1 * | 12/2003 | Miyazaki et al. | 152/527 |
| 2004/0069394 | A1 * | 4/2004 | Armellin et al. | 152/552 |

FOREIGN PATENT DOCUMENTS

| | | | |
|---|---|---|---|
| EP | 0602733 | B1 | 11/1997 |
| EP | 1983098 | A1 | 10/2008 |
| JP | 10-131066 | | 5/1998 |
| JP | 2006-283199 | A | 10/2006 |

OTHER PUBLICATIONS

Anonymous, Polygonally Preformed Steel Elements, Research Disclosure, Jul. 1994, pp. 359-365, Mason Publications, Hampshire, GB.

E. Wolf et al., Alternative Konstruktionen von Stahlzugträgem in Fördergurten, Kautschuk Und Gummi Kunststoffe, Sep. 1993, pp. 727-731, vo. 46, No. 9.

* cited by examiner

*Primary Examiner* — Shaun R Hurley
(74) *Attorney, Agent, or Firm* — Foley & Lardner LLP

(57) ABSTRACT

A steel cord (30) with a high elongation at break of at least 5% comprises n strands (20), each of said strands (20) has m filaments (10) twisted together, n ranges from 2 to 7. m ranges from 2 to 9. The strands and the filaments are twisted in a same direction. The lay length of the cord is Lc and the lay length of said strand is Ls. The ratio of Ls to Lc (Ls/Lc) ranges from 0.25 to 1. Lc ranges from 16 mm to 26 mm. The strands are helically preformed. The E-modulus of the cord is more than 150000 N/mm2. The helical preforming of the strands allows to obtain a high elongation at break and a high E-modulus despite its long lay length Lc.

10 Claims, 2 Drawing Sheets

HIGH ELONGATION STEEL CORD WITH PREFORMED STRANDS

FIELD OF THE INVENTION

The patent relates to a steel cord with a high elongation at break and high E-modulus for reinforcing elastomer product.

BACKGROUND OF THE INVENTION

High elongation at break means the elongation at break of the cord is at least 5%. It is well know that productivity of the cord will increase with the lay length increasing. However, a high lay length of the cord will cause the loss of elongation at break. Once a steel cord is formed with a higher lay length, its elongation at break will be lower. Generally the cord and the strand are twisted in same direction to get a high elongation at break.

In solid mechanics, E-modulus is a measure of the stiffness of a material in the elastic region. It is defined as the ratio of the stress over the strain in the range of stress in which Hooke's Law holds. This can be experimentally determined from the slope of a stress-strain curve created during tensile tests conducted on a sample of the material. To linear materials such as steel, E-modulus is essentially constant over a range of strains.

The stiffness of a cord is of principal importance to keep the tire diameter stable in high speed, so the E-modulus is often one of the primary properties considered when selecting a cord structure. As the E-modulus is higher, the steel cord is stiffer.

U.S. Pat. No. 5,661,966 discloses a steel cord with high lay length and high elongation at break. The steel cord comprising plurality strands has an elongation of more than 5%. The lay length of the cord is 8 to 15 times the diameter of the cord. The filaments of the strand are wavy preformed with a pitch smaller than the lay length of the strands before twisting together. Generally the loss of elongation at break when using long lay length can be compensated by preforming filaments. Although the elongation at break and lay length is high, there is a problem that the E-modulus is small and the steel cord is not very stiff.

3×7 high elongation at break steel cord is a popular cord in the market to reinforce the tire. But there is a drawback that the cord is formed with low lay length. So it is produced with a high cost. The breaking load of the cord is not very high. Also the E-modulus is low so that the cord is not very stiff.

SUMMARY OF THE INVENTION

It is an object of the present invention to overcome the problem of the prior arts. It is a further object of the present invention to provide a stiffer steel cord.

It is another object of the present invention to provide a steel cord with high elongation at break and high E-modulus.

According to the present invention, a steel cord with a high elongation at break being at least 5% comprises n strands, and each of the strands has m filaments twisted together, and n ranges from 2 to 7 while m ranges from 2 to 9. The strands and filaments are twisted in a same direction. The lay length of the steel cord is Lc and the lay length of the strand is Ls. The ratio of Ls to Lc (Ls/Lc) ranges from 0.25 to 1, and Lc ranges from 16 mm to 26 mm. The strands are helically preformed. The E-modulus of the steel cord is more than 150000 N/mm$^2$.

To obtain a stiff steel cord, the steel cord is formed with long lay length. Lc ranges from 16 mm to 26 mm. Preferably Lc ranges from 18 mm to 24 mm. Most preferably Lc is 20 mm.

According to the present invention, the ratio of Ls to Lc (Ls/Lc) ranges from 0.25 to 1. Preferably the ratio ranges from 0.30 to 0.50. Most preferably the ratio is 0.35.

Also as the lay length increases, the productivity increases. And the cost of the product decreases.

To obtain a high elongation at break steel cord, the strand is helically preformed before being twisted into a steel cord. Due to the helically pre-formation, the strand has a three dimensional deformation. Also the strand can get a good surface, fatigue and adhesion.

According to the present invention, the strand has pitch Ps for the preformation (which is different from the twisting pitch) and amplitude As for the preformation. Preferably Ps is 50 to 120 times diameter D of the filament. Most preferably Ps is 70 to 100 times diameter D. Preferably As is 8 to 12 times diameter D of the filament. Most preferably As is 9 to 11 times diameter D.

Preferably the Ps is equal to Lc, which means that the lay length of the cord Lc is equal to the pitch of the preformation. This has an advantage that the preformation can be done immediately before the twisting, making use of the rotational movement that the strands already have just before the twisting point or cord formation point.

The steel cord with such long lay length has an E-modulus more than 150000 N/mm$^2$. Preferably the E-modulus is more than 160000 N/mm$^2$.

Due to the pre-formation on the strands and same twisting direction of strands and filaments, the elongation at break of the steel cord is at least 5%. Even it reaches to 10%.

The filament reinforcing the steel cord has a diameter D ranging from 0.05 mm to 0.60 mm. Preferably diameter D ranges from 0.10 mm to 0.45 mm. Generally diameter D can be 0.10, 0.12, 0.13, 0.15, 0.175, 0.20, 0.22, 0.245, 0.25, 0.265, 0.27, 0.28, 0.30, 0.32, 0.35, 0.38, 0.40, 0.42 or 0.45 mm.

The steel cord has a structure of n×m. The n ranges from 2 to 7, and m ranges from 2 to 9. The cord can be 2×2, 2×3, 2×4, 2×5, 2×6, 2×7, 2×8, 2×9, 3×2, 3×3, 3×4, 3×5, 3×6, 3×7, 3×8, 3×9, 4×2, 4×3, 4×4, 4×5, 4×6, 4×7, 4×8, 4×9, 5×2, 5×3, 5×4, 5×5, 5×6, 5×7, 5×8, 5×9, 6×2, 6×3, 6×4, 6×5, 6×6, 6×7, 6×8, 6×9, 7×2, 7×3, 7×4, 7×5, 7×6, 7×7, 7×8 or 7×9.

The steel cord is used for reinforcing the elastomer product. The elastomer product can be a tyre of passenger car, bus, truck, earthmover and off-the-road tyre.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

A steel filament 10 can be made as follows:

Wire rod forms the starting material. Wire rod has a typical composition along the following lines: a carbon content ranging from 0.60% to 1.25%, a manganese content ranging from 0.20% to 1.10%, a silicon content ranging from 0.10% to 0.90%, sulfur and phosphorous contents being limited to 0.10%, additional micro-alloying elements such as chromium (up to 0.20%-0.40%), copper (up to 0.20%), vanadium (up to 0.30%), boron, nickel, molybdenum, niobium, copper calcium, aluminum, titanium, and nitrogen may be added.

The wire rod is drawn in a first series of dry drawing steps into a steel wire with an intermediate diameter. The steel wire is then subjected to a heat treatment such as patenting in order to allow for further drawing. The steel wire can be coated with a brass coating, e.g. by means of a diffusion process applied to a zinc and a copper coating.

The brass coated steel wire is then drawn until a steel filament 10 with a final filament diameter.

For a final filament 10, the tensile strength of the final steel filament 10 may vary between 2000 MPa and 5000 MPa. May be the tensile strength is more than 3500 MPa. Even the tensile strength is more than 4000 MPa.

Figure 1:
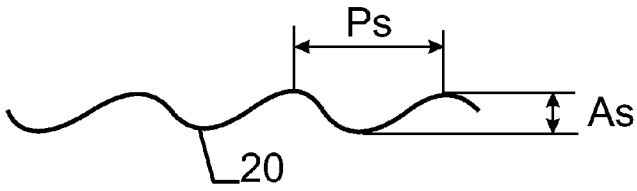
FIG. 1 shows a front view of a strand with a helically pre-formation

FIG. 1 shows a front view of helically preformed strand 20. The strand 20 is formed with 7 filaments 10 with a diameter D of 0.22 mm. The filaments 10 are parallel and then twisted with a twisted pitch, so that the strand 20 has a lay length Ls of 7 mm. 3 strands 20 are helically preformed.

Figure 2:
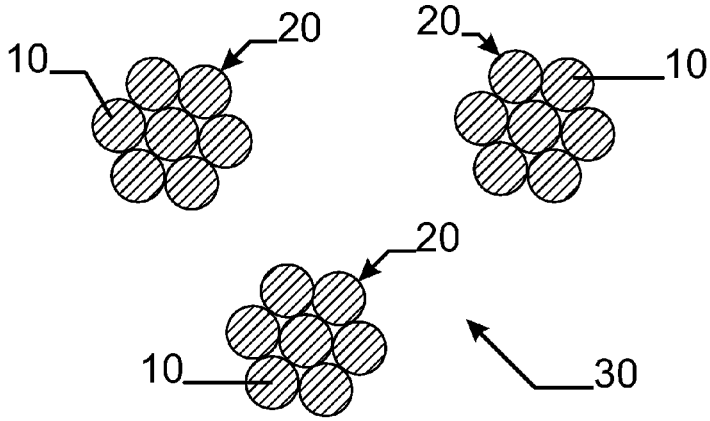
FIG. 2 shows a sectional view of a steel cord comprising preformed strands with a structure of 3×7

FIG. 2 shows the sectional view of a first preferred embodiment steel cord 30 with a structure of 3×7. 3 strands are twisted with a long lay length in the same direction with the filaments into steel cord 30.

Finally the lay length of the steel cord 30 Lc is 20 mm. The strand 20 has preformation pitch Ps of 19.9 mm and preformation amplitude As of 2.10 mm.

Due to the long lay length and preformed strands, the steel cord 30 has high E-modulus and high elongation at break.

Compared with a prior art 3×7 steel cord which strands are not preformed and lay length is low, some properties are measured. The table below shows the results.

TABLE 1

| | Steel Cord 30 | Prior art 3 × 7 steel cord |
|---|---|---|
| Diameter of the filament (mm) | 0.22 | 0.22 |
| Lay length of the strand (mm) | 7 | 4.8 |
| Lay length of the cord (mm) | 20 | 8 |
| Diameter of the cord (mm) | 1.449 | 1.443 |
| Filaments with pre-formation | No | No |
| Strands with pre-formation | Yes | No |
| Structural elongation (%) | 2.0 | 1.9 |
| Elongation at break of the cord (%) | 5.12% | 5.14% |
| Breaking load of the cord (N) | 2339 | 2084 |
| E-modulus of the cord (N/mm$^2$) | 163287 | 105510 |

From the Table 1, compared with the prior art steel cord, the diameter and structural elongation of the steel cord 30 has no obvious difference. But the breaking load of the steel cord 30 increases obviously. Especially the E-modulus of the steel cord 30 is nearly 55% higher than that of the prior art steel cord. In other words the steel cord 30 is stiffer than the prior art steel cord.

Figure 5:
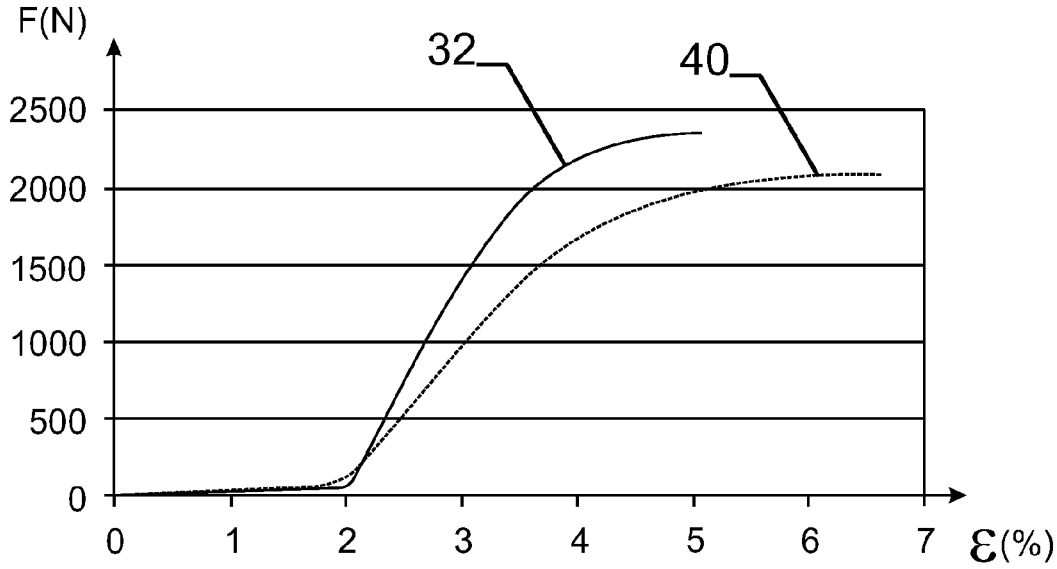
FIG. 5 shows a Force-Elongation curve of two steel cords, one is the invented steel cord and another is prior art steel cord

FIG. 5 shows the Force-Elongation curve 32 of the steel cord 30 and the Force-Elongation curve 40 of prior art steel cord. Also the difference on the E-modulus between the steel cord 30 and the prior art steel cord is great. The E-modulus of the steel cord 30 is higher than that of the prior art steel cord.

Figure 3:
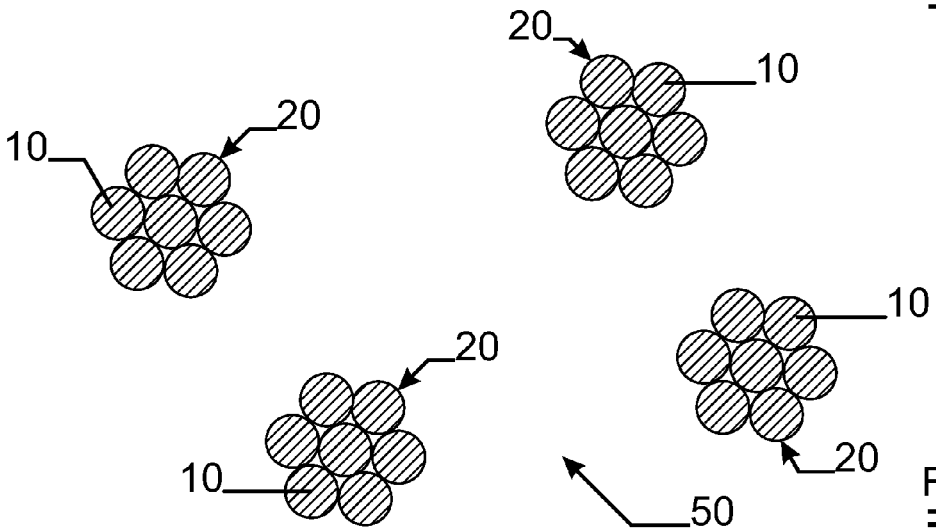
FIG. 3 shows a sectional view of a steel cord comprising preformed strands with a structure of 4×7

FIG. 3 shows a sectional view of a second preferred embodiment steel cord 50 comprising 4 helically preformed strands 20 and having a lay length Lc of 20 mm. The elongation at break is 5.5%. The E-modulus of the steel cord 50 is 175324 N/mm$^2$.

Figure 4:
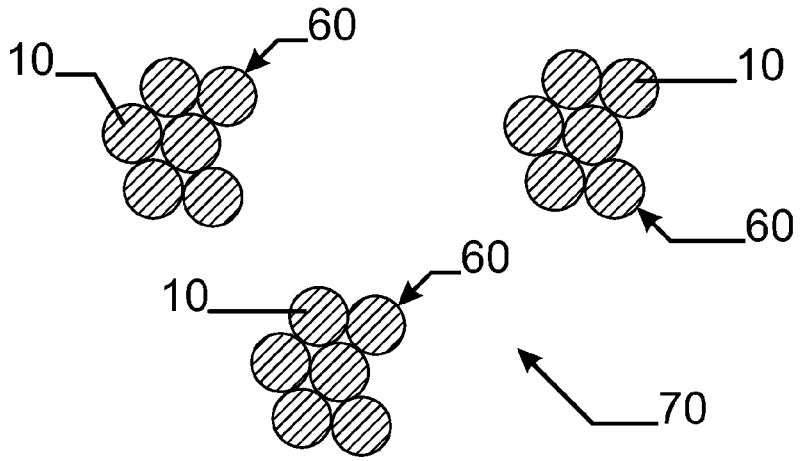
FIG. 4 shows a sectional view of a steel cord comprising preformed strands with a structure of 3×6

FIG. 4 shows a sectional view of a third preferred embodiment steel cord 70 comprising 3 helically preformed strands 60 and having a lay length Lc 23 mm. Each strand 60 comprises 6 filaments. The lay length of the strand 60 Ls is 11.2 mm. The strand 60 has preformation pitch Ps of 29.8 mm and preformation amplitude As of 2.16 mm. The elongation at break of the steel cord 70 is 5.6%. The E-modulus of the steel cord 70 is 155324 N/mm$^2$.

The invention claimed is:

1. A steel cord with a high elongation at break being at least 5% comprising n strands, said strands being helically preformed, each of said strands having m filaments twisted together, said n ranging from 2 to 7, said m ranging from 2 to 9, said strands and said filaments being twisted in a same direction, a lay length of said cord being Lc and a lay length of said strand being Ls, wherein a ratio of said Ls to said Lc (Ls/Lc) ranges from 0.25 to 1, said Lc ranges from 16 mm to 26 mm, and wherein an E-modulus of said steel cord is more than 150000 N/mm$^2$; and wherein said helically preformed strand has a preformation pitch Ps and a preformation amplitude As, said Ps is 50 to 120 times a diameter D of the filament and said As is 8 to 12 times the diameter D of the filament.

2. A steel cord as claimed in claim 1, wherein said Lc ranges from 18 mm to 24 mm.

3. A steel cord as claimed in claim 1, wherein said Lc is 20 mm.

4. A steel cord as claimed in claim 1, wherein said ratio of said Ls to said Lc (Ls/Lc) ranges from 0.30 to 0.50.

5. A steel cord as claimed in claim 1, wherein said ratio of Ls to said Lc (Ls/Lc) is 0.35.

6. A steel cord as claimed in claim 1, wherein said Ps is 70 to 100 times the diameter D and said As is 9 to 11 times the diameter D.

7. A steel cord as claimed in claim 1, wherein said Ps is equal to said Lc.

8. The use of steel cord as claimed in claim 1 in reinforcing elastomer product.

9. A steel cord, with a high elongation at break being at least 5% comprising n strands, said strands being helically preformed, each of said strands having m filaments twisted together, said n ranging from 2 to 7, said m ranging from 2 to 9, said strands and said filaments being twisted in a same direction, a lay length of said cord being Lc and a lay length of said strand being Ls; wherein a ratio of said Ls to said Lc (Ls/Lc) ranges from 0.25 to 1, said Lc ranges from 16 mm to 26 mm, wherein an E-modulus of said steel cord is more than 150000 N/mm$^2$; and wherein said n is 3 while said in is 7.

10. A steel cord, with a high elongation at break being at least 5% comprising n strands, said strands being helically preformed, each of said strands having m filaments twisted together, said n ranging from 2 to 7, said m ranging from 2 to 9, said strands and said filaments being twisted in a same direction, a lay length of said cord being Lc and a lay length of said strand being Ls, wherein a ratio of said Ls to said Lc (Ls/Lc) ranges from 0.25 to 1, said Lc ranges from 16 mm to 26 mm, and wherein an E-modulus of said steel cord is more than 150000 N/mm$^2$; wherein said helically preformed strand has a preformation pitch Ps and a preformation amplitude As; wherein said Ps is 70 to 100 times a diameter D of the filament and said As is 9 to 11 times the diameter D of the filament; and wherein said Ps is equal to said Lc.

* * * * *